United States Patent [19]

Mello

[11] 3,968,882

[45] July 13, 1976

[54] COMPLETE SET OF ELEMENTS FITTING IN UNIT-COMPOSED SUPPORTING SYSTEMS

[75] Inventor: Fabio Mello, Milan, Italy

[73] Assignee: Commerciale Sacea, S.a.s., Milan, Italy

[22] Filed: Nov. 12, 1973

[21] Appl. No.: 414,665

[30] Foreign Application Priority Data

Nov. 14, 1972 Italy ..... 31624/72
Oct. 31, 1973 Italy ..... 30764/73

[52] U.S. Cl. ..... 211/189; 211/182; 248/188.7

[51] Int. Cl.[2] ..... A47F 5/00

[58] Field of Search ..... 211/177, 182, 183; 248/188.7, 224; 5/300

[56] References Cited

UNITED STATES PATENTS

| | | | |
|---|---|---|---|
| 660,196 | 10/1900 | Myers | 5/300 |
| 1,173,647 | 2/1916 | Carmody | 5/300 |
| 2,962,170 | 11/1960 | Best | 403/187 |
| 3,415,554 | 12/1968 | Papayoti | 403/187 |
| 3,451,183 | 6/1969 | Lespagnol et al. | 403/220 |
| 3,524,616 | 8/1970 | Marschak | 211/177 |
| 3,547,275 | 12/1970 | Engel | 211/177 |
| 3,612,585 | 10/1971 | Mayr | 211/177 |
| 3,670,899 | 6/1972 | Kronenberg et al. | 211/182 |
| 3,719,340 | 3/1973 | Norton | 248/188.7 |
| 3,724,678 | 4/1973 | Challier | 403/189 |
| 3,778,175 | 12/1973 | Zimmer | 403/187 |

*Primary Examiner*—Roy D. Frazier
*Assistant Examiner*—Darrell Marquette
*Attorney, Agent, or Firm*—Kenyon & Kenyon Reilly Carr & Chapin

[57] ABSTRACT

A set of elements fitting in unit-composed systems for office and house furniture comprises a vertical supporting rod having at the bottom and at the top a plurality of slots for the interchangeable radial connection, respectively with a base and with a bar for mounting panels, containers, shelves, etc, by means of a properly shaped plate.

The bar comprises at least two elements and preferably a central one connected to end joints, provided with inner passages for housing electric and/or telephone wires therein. For example these passages are formed by a H beam associated with two opposite outer channels. For the passage of said wires from the vertical rod to the bar, a connecting box may be provided.

10 Claims, 8 Drawing Figures

COMPLETE SET OF ELEMENTS FITTING IN UNIT-COMPOSED SUPPORTING SYSTEMS

BACKGROUND OF THE INVENTION

The present invention relates to a complete set of elements fitting in unit-composed supporting systems, in particular to a set of elements arranged for housing and insulating wires, for instance electric and telephone wires, and suitable for unit-composed systems, fit to support and assemble working surfaces, archives shelves, partition panels, etc. These elements can be variously and widely used in the furnishings field in general and in the office furniture and rooms in particular.

It is known that in accordance with the more advanced job organization, a strong trend was marked toward a homogeneous and functional space distribution of work places. In fact, taking in due consideration a precise operative functionality, there is a trend toward the creation of collective work zones with strictly rational furnishings, where volumes and spaces can be continually adapted to ever new and changeable requirements.

So far the above mentioned standards are generally not carried out because of the comparatively slow process of adaptation and transformation of the furnishings industry which is usually, more responsive to aesthetic than to rational requirements.

To a large extent, supporting structures are in fact assembled by means of screw and bolts, thus preventing them from easy changes. Moreover these structures are composed of various and an indefinite number of different non-standard elements, which are specifically designed for a particular environment. At last, the known supporting system elements for office furniture, are not arranged for housing and insulating electric and telephone wires according to various and non-rectilinear directions.

SUMMARY OF THE INVENTION

It is an object of the present invention, in order to basically guarantee a flexible and functional organization of open space, to provide a minimum number of standard elements, whose repeated employment allows the highest furnishings combination, a quick and easy change of one combination into another and a partial transformation without alteration of the remaining parts, so that the enlargement or the reduction of a certain combination is not dependent on the combination itself.

Another object of the present invention is to provide a whole set of elements, fit for housing and insulating wires, as electric and telephone wires, and capable of assembly without screws or bolts in unit-composed systems, variously jointed, for supporting and assembling working surfaces, archives shelves, partition panels, etc.

The set of elements according to the present invention essentially comprises a vertical rod, provided with an axial slot passing therethrough, and having a plurality of slots at both upper and lower ends; a base with engagement means to be housed in one of the slots of the lower end of the vertical rod; a bar formed at least by two elements and provided at each of both ends with engagement means to be inserted in one slot of the upper end of the vertical rod; and a plate adapted to connect the bar with furnishings elements such as panels, resting surfaces, archives containers, shelves, etc.

BRIEF DESCRIPTION OF THE DRAWINGS

The present invention will be now described more in detail with reference, only by way of a nonlimiting example, to a preferred embodiment illustrated in the annexed drawings, wherein.

DESCRIPTION OF THE PREFERRED EMBODIMENT

Figure 1:
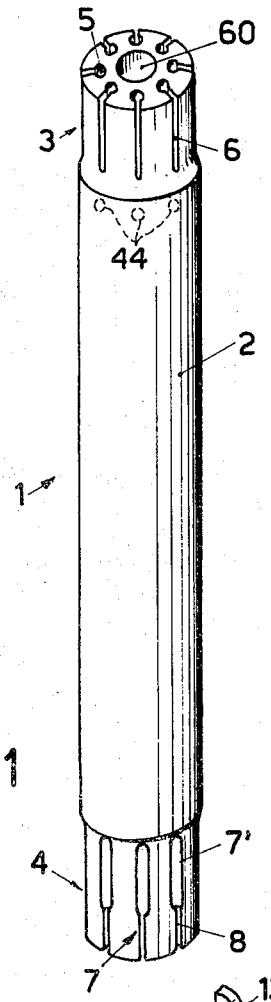
FIG. 1 is a perspective view of a vertical rod of the set of elements according to a preferred embodiment of the present invention.

With reference to FIG. 1, a vertical rod 1 having a cylinder-shaped shank 2 and joints 3 and 4 at both ends, upper and lower at both sides of shank 2. The joint 3, as illustrated by FIG. 1, has a plurality of slots 6 along equally spaced generating lines of vertical rod 1. The slot shape is substantially the same as the one resulting from the longitudinal combination of a cylinder and a rectangular parallelepipedon. The cylindrical portion of each slot is marked with reference numeral 5. According to the illustrated embodiment, the slots 6 are radially spaced by a 45° interval, thus allowing the fixing of a bar 14 (FIG. 3) in accordance with anyone of the eight corresponding directions. The bar 14 is in fact stiffly connected to the vertical rod 1 by engaging its terminal element 20 into one of the eight slots 6. The terminal element 20 functions as an engagement means and comprises a parallelepipedon element 19' and a cylindrical element 19 adapted to be fitted in the corresponding cylindrical portion 5 of the slot 6 of the joint 3. The vertical rod 1 is also provided with an axial slot passage 60 passing therethrough.

Figure 2:
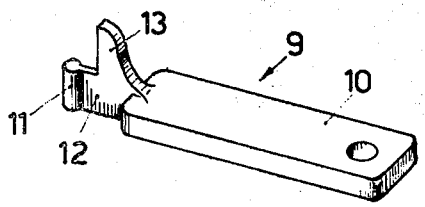
FIG. 2 is a perspective view of a base of the set of elements according to a preferred embodiment of the present invention.

Analogously a plurality of equally spaced slots 7 (eight slots according to the illustrated embodiment) are formed on the joint 4 of the vertical rod 1, thus allowing the engagement of a terminal element 12 of the base 9 of FIG. 2. The slots 7 are provided, similarly to the above mentioned slots 6, with eight cylindrical portions 8 wherein, when assembled, the cylindrical terminal 11 of the base 9 is engaged. Furthermore the slots 7 are shaped in order to permit a quick disassembly of the base 9, being provided at their upper ends with a widening 7' allowing the release of the cylindrical element 11 just by lifting the base 9 and drawing it out. The base 9 may be engaged in the opposite manner. FIG. 2 points out the simple structure of the base 9, which comprises a 10, having integral with the said element 12 with the cylindrical element 11. The element 12 is also characterized by a step, or a shoulder 13, as a guide for the joint 4 during the engagement and eventually as an auxiliary support of the shank 2 for the vertical rod 1.

Figure 4:
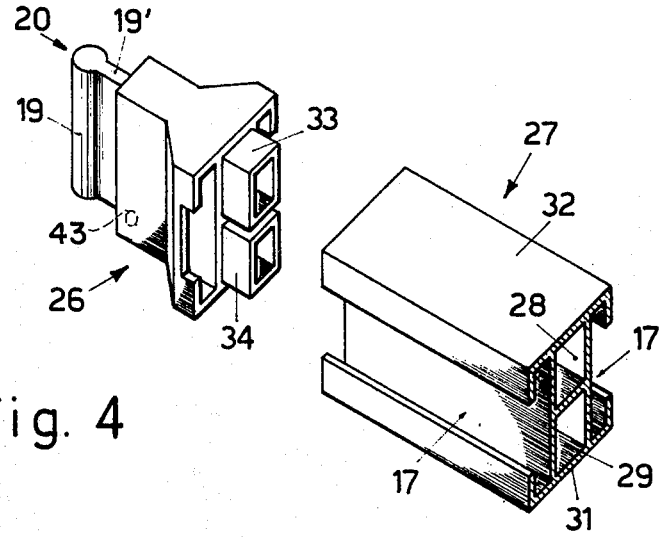
FIG. 4 is a perspective partial view of the bar of FIG. 3 before the assemblage.
Figure 3:
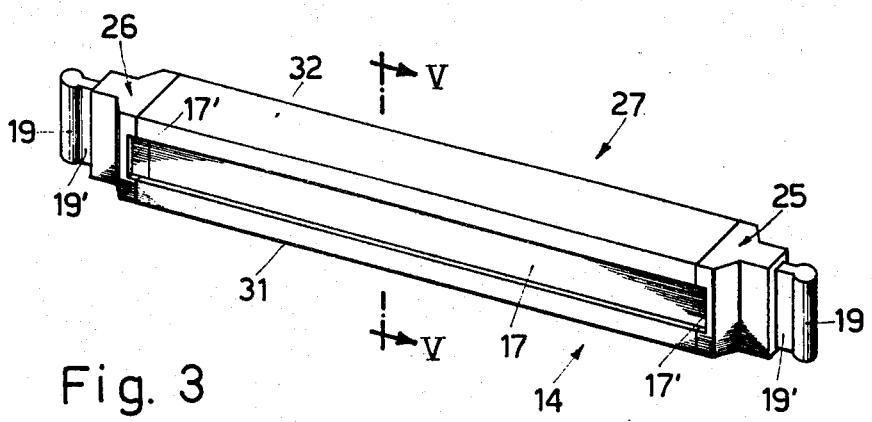
FIG. 3 is a perspective view of a completely assembled supporting bar of the set of elements according to a preferred embodiment of the present invention.
Figure 5:
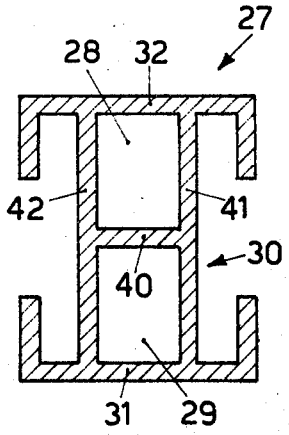
FIG. 5 is a sectional view of the central element of the bar of FIG. 3 along the line V—V.

The bar 14 in accordance with FIGS. 3–4–5 can house electric, telephone and other wires. According to the illustrated preferred embodiment the bar 14 comprises three elemental parts. Outer parts 25 and 26 act as a joint, whilst the central part 27 is load-bearing or supporting. As illustrated by FIG. 4, showing in a perspective view a part of the supporting section 27 and one of two side joints (for instance the joint 26), the bar 14 is provided with two inner passages 28 and 29 suitable for wire-housing. More precisely, as FIG. 5 shows in a sectional view, the central part 27 of the bar 14 is composed by one H beam 30 and two opposite channels 31 and 32. The webs of channels 31 and 32 are parallel to H beam's one. The inner passages 28 and 29 are created by the webs of two channels 31 and 32 and the web of the H beam 40 together with its platbands. Each one of the two joints 25 and 26 is provided with a terminal 20, which, as above mentioned, can be housed in one of the eight slots 6 formed in the joint 3 of the vertical rod 1.

Opposite to the terminal 20, each one of the two joints 25 and 26 is provided with two protruding hollow couplings 33 and 34, substantially composed by two rectangular parallelepipedons suitable to be tightly housed in the passages 28 and 29. Moreover the part 27 of the bar 14 presents a slot 17 on both sides which can house, when assembled, the connecting plate 21.

Figure 6:
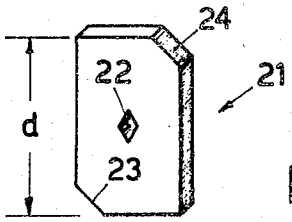
FIG. 6 is an elevation view of a connecting plate included in the set of elements according to the present invention.
Figure 8:
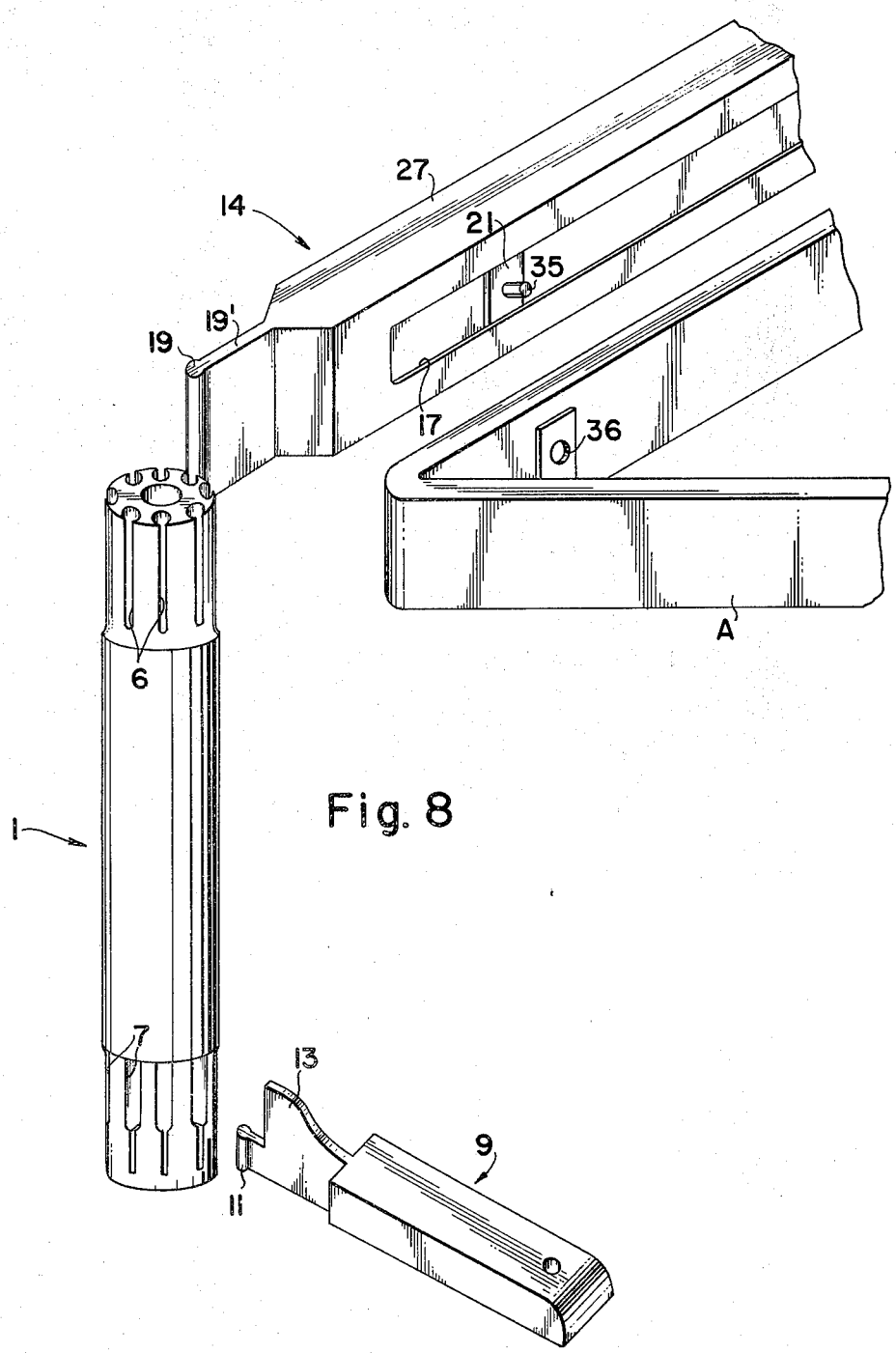
FIG. 8 illustrates an exploded view of an assembly according to the invention adjacent a furniture element.

According to the embodiment illustrated in FIGS. 6 and 8, the connecting plate 21 is substantially formed by a rectangle element with two opposite beveled corners 23 and 24, and with a central quadrangular hole 22. When assembled, the plate 21 is just the connecting element between whatsoever working surface or panel (where it is fixed by means of the hole 22) and the bar 14. That is, the plate 21 serves of itself to mount the central part 27 of a bar 14 directly to a furniture element A or panel. Thus, the plate 21 has the function of a clamping means for fastening a furniture element on the bar 14. The plate 21 is made integral with the element A via a screw or bolt 35 in the hole 22 in the plate 21 and a suitable threaded aperture 36 in the furniture element A while being inserted in one of the side slots 17 of the central part 27. The connecting plate 21 length *d* is equal to the width of the platbands 41 and 42 of the H beam 30, in order to be clamped, when assembled, between the webs of channels 31 and 32, which come into contact with both shorter sides.

Figure 7:
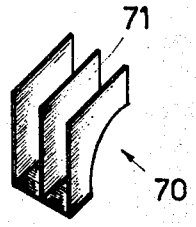
FIG. 7 is a perspective view of a connecting box suitable for a wire-housing.

FIGS. 3 and 4 point also out slots 17' of joints 25 and 26 opposite to the slots 17 of the central part 27 of the bar 14. The bar 14 not only can house wires inside the passages 28 and 29, but can also separate them, for instance telephone from electric wires, by means of the web 40 of the H beam 30. Obviously the bar 14 can be provided inside the passages 28 and 29 with an insulating layer, easily made by extrusion during the production of the bar itself. Moreover the vertical rod 1 can also house telephone and electric wires in the axial slot 60. The complete set of elements fitting in unit-composed supporting systems according to the present invention can therefore wholly embody the wires of a electric and telephone system. The wires can be passed from the vertical rod 1 to the bar 14 both through a hole 43 (shown in phantom in FIG. 4) opposite to the cylindrical element 19 of the joints 25 and 26 and preferably through a hole 44 (shown in phantom in FIG. 1) to be made on the vertical rod 1 just below the joint 3, and then through a connecting box, for instance like box 70 of FIG. 7, suitable for wire-housing and fitted inside with a partition screen 71 to separate wires. When assembled, this box 70 connects the upper part of the vertical rod 1 with the bar 14.

It is important to point out that the fitting elements in accordance with the present invention, allow the electrification of widely jointed structures, thus remarkably improving safety, praticalness and aesthetics.

It will be also noticed that the described elements can have a wide range of applications different to the above mentioned ones, as for instance the assembly of partition walls or bank agency counters, and so on.

Although the present invention has been described in detail with reference to the annexed drawings and to a particularly preferred embodiment, it is obvious that adaptations and/or modifications can be brought by those skilled in the art without departing from the scope of the invention itself.

What I claim is:

1. A combination for office furniture comprising a vertically disposed rod having an axial passage passing therethrough and a plurality of radially directed slots at an upper end, at least some of said slots being shaped in a shape of a cylinder and a rectangular parallelepipedon, said passage being disposed for receiving at least one wire;

a horizontally disposed bar having at least one inner passage for receiving at least one wire, and said bar having at least one slot;

a terminal element secured to an end of said bar and having a parallelepipedon element and a cylindrical element fitted in a respective one of said shaped slots of said rod for securing said bar to said rod; and a connecting plate of rectangular shape with a central hole, said plate being clamped within said slot of said bar.

2. The combination as set forth in claim 1 wherein said rod has a plurality of radially directed slots at a lower end and which further comprises a base having a terminal element engaged within one of said slots at said lower end.

3. The combination as set forth in claim 2 wherein said slots at said lower end each have a widening at an upper end to allow withdrawal of said terminal element of said base.

4. The combination as set forth in claim 1 wherein said rod has a hole below said slots in said upper end for outward passage of a wire from said passage in said rod and said bar has a hole for passage of the wire from said rod into said inner passage of said bar.

5. The combination as set forth in claim 1 wherein said bar has two outer parts and a central part, said central part being formed of an H-shaped beam and a pair of opposite channels to define two said inner passages and two outer slots.

6. The combination as set forth in claim 5 wherein at least one of said outer parts of said bar has means for allowing assembly with said central part on one side, and said terminal element is integral with the opposite side of said outer part.

7. A combination for office furniture comprising a vertically disposed rod having an axial passage passing therethrough for receiving at least one wire, a plurality of radially directed slots at an upper end, at least some of said slots being shaped in a shape of a cylinder and a rectangular parallelepipedon, and a plurality of radially directed slots at a lower end, each of said latter slots having a widening at an upper end thereof;

a horizontally disposed bar having at least one inner passage for receiving at least one wire;

a terminal element secured to an end of said bar and having a parallelepipedon element and a cylindrical element fitted in a respective one of said shaped slots at said upper end of said rod for securing said bar to said rod; and a base having a terminal element engaged within one of said slots at said lower end and sized for withdrawal through the widening of said one slot.

8. The combination as set forth in claim 7 wherein said rod has a hole below said slots in said upper end for outward passage of a wire from said passage in said rod and said bar has a hole for passage of the wire from said rod into said inner passage of said bar.

9. The combination as set forth in claim 7 wherein said bar has two outer parts and a central part, said central part being formed of an H-shaped beam and a pair of opposite channels to define two said inner passages and two outer slots.

10. The combination as set forth in claim 9 wherein at least one of said outer parts of said bar has means for allowing assembly with said central part on one side, and said terminal element is integral with the opposite side of said outer part.

* * * * *

UNITED STATES PATENT AND TRADEMARK OFFICE

CERTIFICATE OF CORRECTION

PATENT NO. : 3,968,882

DATED : July 13, 1976

INVENTOR(S) : FABIO MELLO

It is certified that error appears in the above-identified patent and that said Letters Patent are hereby corrected as shown below:

Column 2, last line, delete

"9, which comprises a 10, having integral with the said"

and insert

--9, which comprises a base 10, integral with the".

Signed and Sealed this

Thirtieth Day of November 1976

[SEAL]

*Attest:*

RUTH C. MASON
*Attesting Officer*

C. MARSHALL DANN
*Commissioner of Patents and Trademarks*